United States Patent [19]

Case

[11] Patent Number: 4,765,615

[45] Date of Patent: Aug. 23, 1988

[54] EXERCISING APPARATUS

[76] Inventor: William S. Case, 6000 Reims St., #2107, Houston, Tex. 77036

[21] Appl. No.: 40,792

[22] Filed: Apr. 21, 1987

[51] Int. Cl.[4] ..... A63B 21/00

[52] U.S. Cl. ..... 272/132; 272/134; 272/DIG. 4; 242/158 R

[58] Field of Search ..... 272/72, 130–144, 272/DIG. 4, 70, 96, 97, 129, 901, 902; 242/158 R

[56] References Cited

U.S. PATENT DOCUMENTS

| | | | |
|---|---|---|---|
| 1,118,270 | 11/1914 | Dahl | 242/158 R |
| 2,862,710 | 12/1958 | Lewis | 272/134 X |
| 2,868,504 | 1/1959 | Minty | 242/158 R |
| 3,051,482 | 8/1962 | Harpham | 272/139 X |
| 3,117,782 | 1/1964 | Johnston | 272/134 X |
| 3,345,067 | 10/1967 | Smith | 272/134 |
| 3,421,760 | 1/1969 | Freeman, Jr. | 272/142 X |
| 3,428,312 | 2/1969 | Machen | 272/134 |
| 3,825,252 | 7/1974 | Geiger | 272/142 X |
| 3,874,659 | 4/1975 | Aharoni | 272/132 X |
| 4,066,259 | 1/1978 | Brentham | 272/DIG. 4 X |
| 4,227,689 | 10/1980 | Keiser | 272/134 X |
| 4,235,439 | 11/1980 | De Donno | 272/132 |
| 4,468,026 | 8/1984 | Roark | 272/136 |
| 4,537,393 | 8/1985 | Kusch | 272/142 X |
| 4,640,268 | 2/1987 | Roberts | 272/DIG. 4 X |

FOREIGN PATENT DOCUMENTS

| | | | |
|---|---|---|---|
| 766608 | 9/1980 | U.S.S.R. | 272/70 |

*Primary Examiner*—Richard J. Apley
*Assistant Examiner*—Robert D. Bahr
*Attorney, Agent, or Firm*—Dodge, Bush & Moseley

[57] ABSTRACT

Exercising apparatus (10) including a seat (21) on which a user (U) is seated for exercising, a rear tensioning device (24) positioned behind the seat (21) and mounted for movement between opposed sides of the user (U), and a front tensioning device (28) in front of the seat (21) mounted for movement on a pivotally mounted leg (32) between opposite sides of the user (U). Flexible cables (26, 30) extend from the tensioning devices (24, 28) and are connected to a cuff (22) about the ankle of the user (U). The force exerted through the flexible cables (26, 30) may be adjusted by manual setting of a rotatable knob (102) on the tensioning devices (24, 28) which increases the resistance to unwinding of the cable (26, 30) from its associated drum (77) of the respective tensioning device (24, 28).

19 Claims, 3 Drawing Sheets

FIG.2
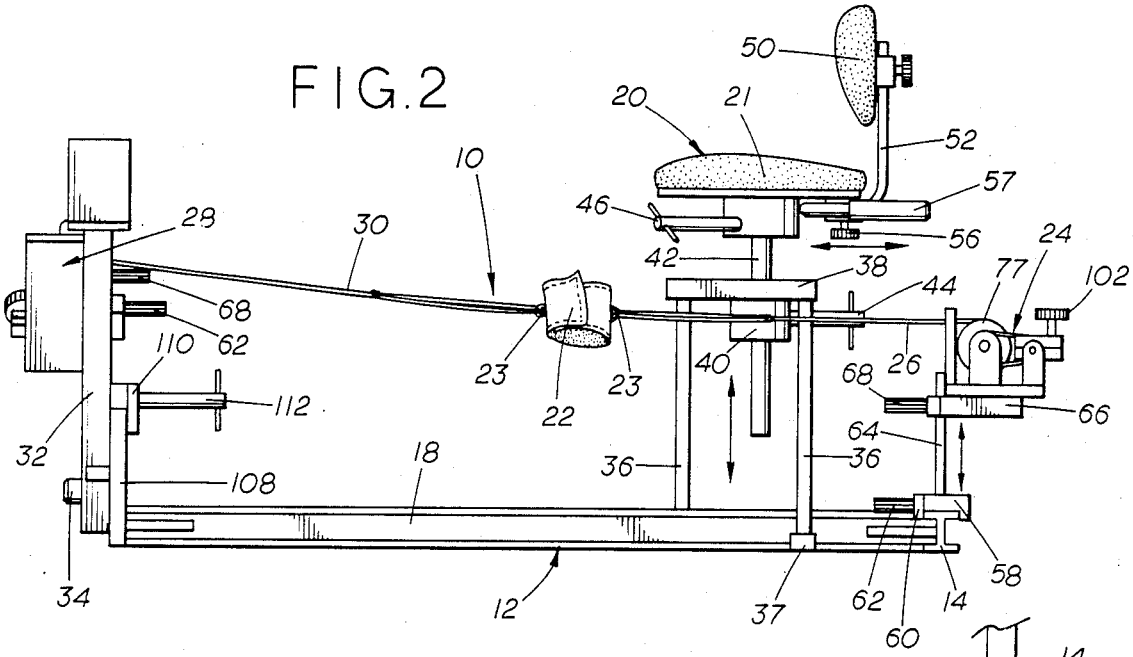
FIG.1
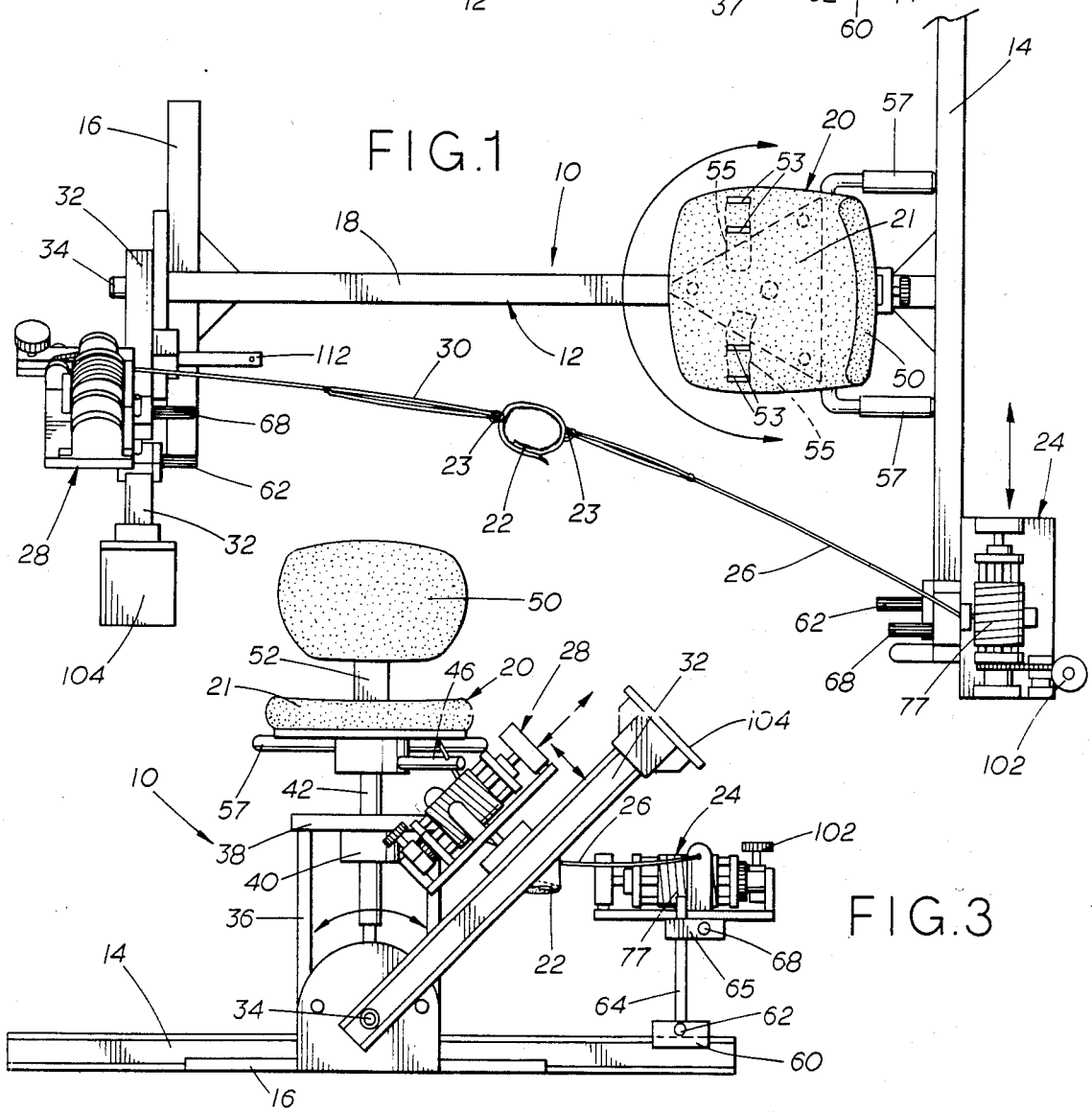
FIG.3

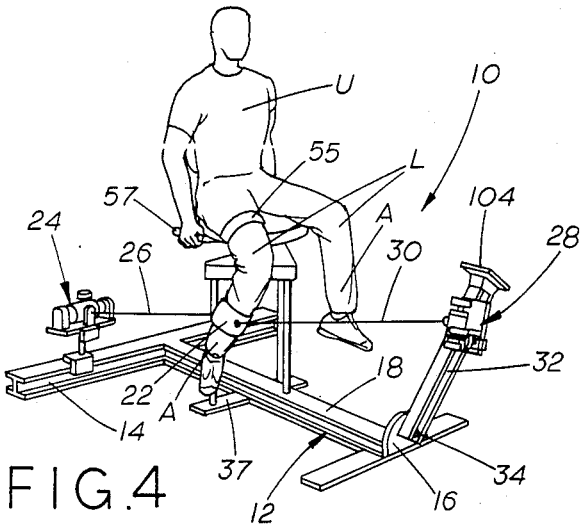
FIG.4
FIG.5
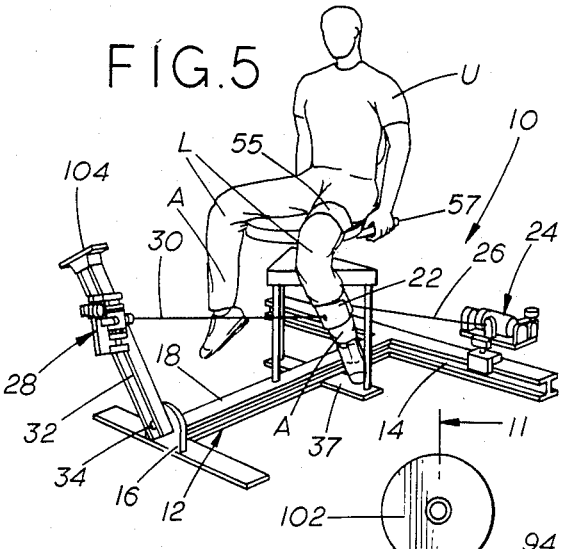
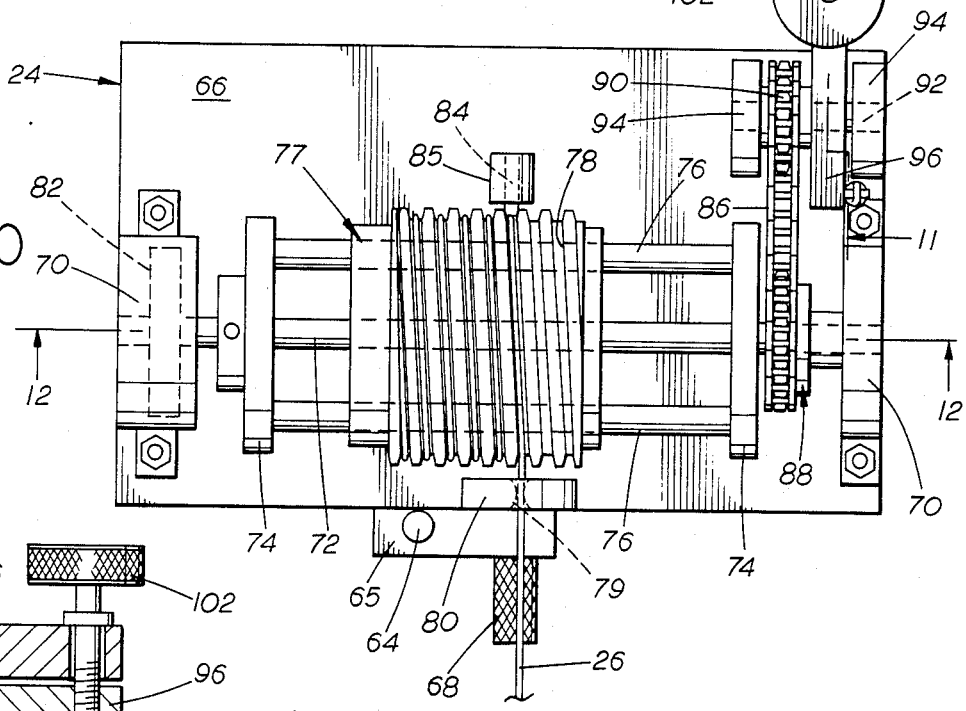
FIG.10
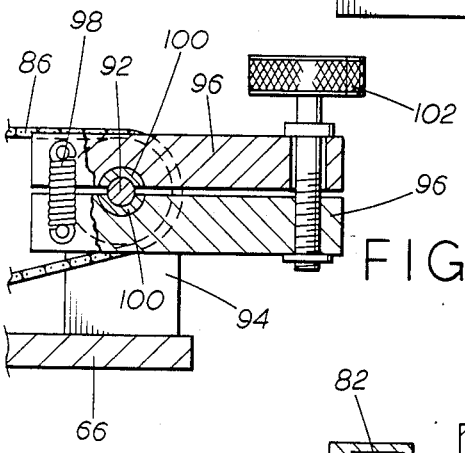
FIG.11
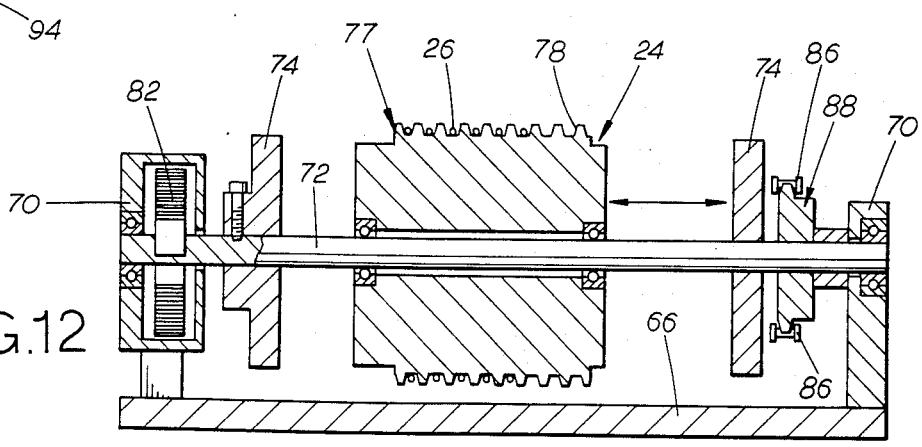
FIG.12

FIG.6
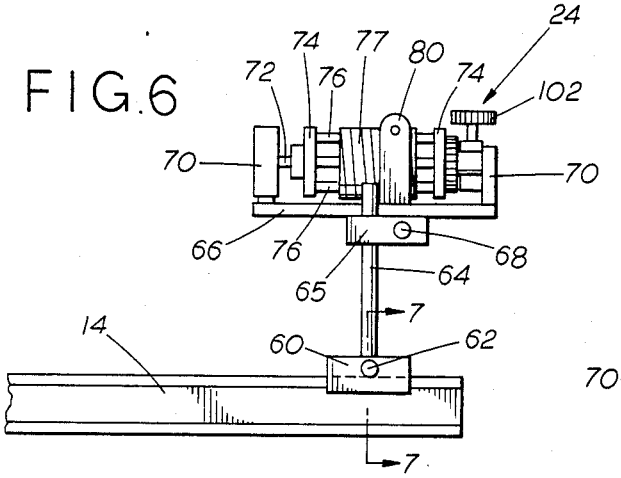
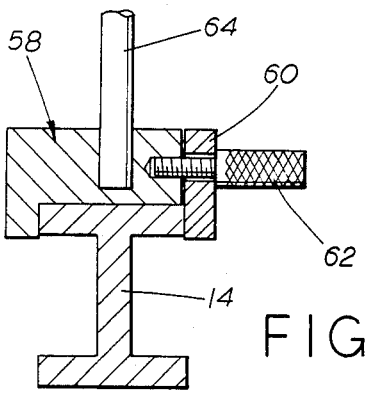
FIG.7
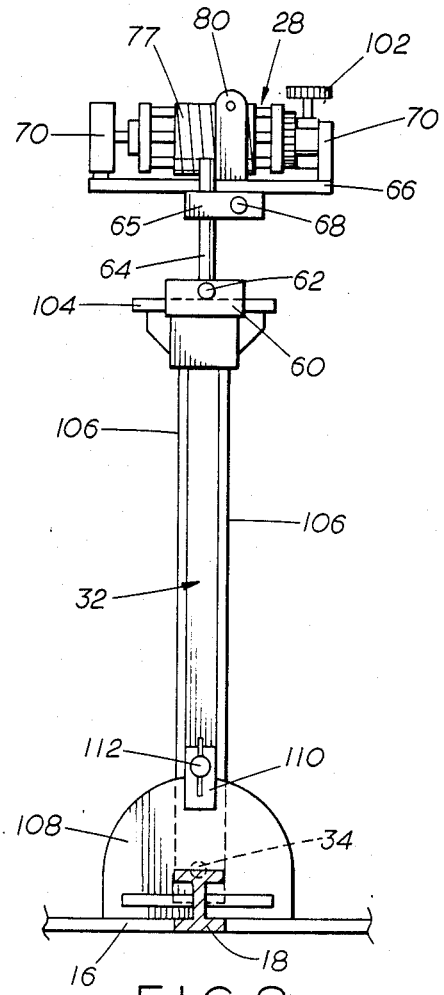
FIG.8
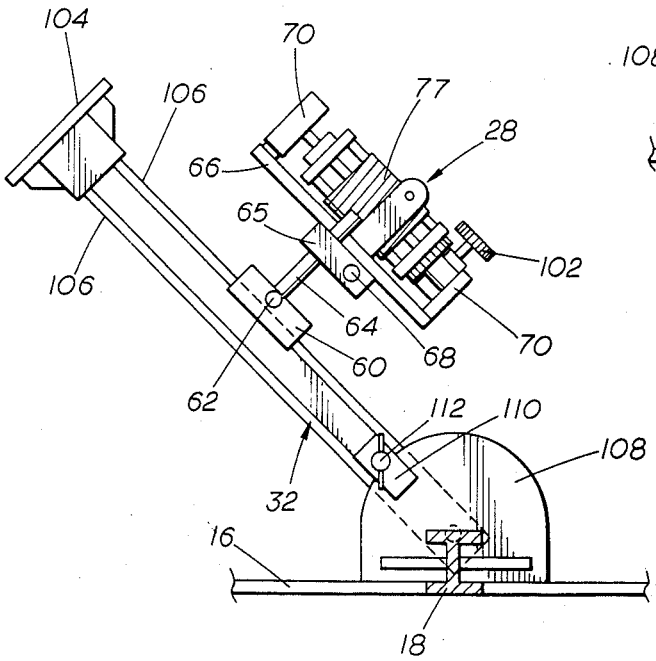
FIG.9

EXERCISING APPARATUS

BACKGROUND OF THE INVENTION

This invention relates to body exercising apparatus and more particularly to such exercising apparatus for exerting oppositely directed tensioning forces against the body of a user.

Heretofore, various types of exercising apparatus have been provided utilizing tensioning devices which may be gripped or otherwise connected to body portions of a user for exercising various muscles of the body. For example, U.S. Pat. No. 552,971 dated Jan. 14, 1896 shows an exercising apparatus in which elastic cables or ropes are connected to the legs or feet of a user and upon movement of the knees of a user toward each other, and then back to their original position, exercise of the knees is provided. The user is seated on a seat and may grip means for maintaining the position on the seat. However, only one elastic strap or cable is connected to a leg in U.S. Pat. No. 552,971 and retraction of the strap does not result in exercising the leg.

U.S. Pat. No. 1,867,642 dated July 19, 1932 shows an exercising apparatus in which a user grasps hand grips which are connected to flexible pull cables wound around a drum urging the cables to a retracted position. The amount of bias exerted by the cables is unidirectional and determined by retraction of a coil spring connected to the shaft for winding the cables.

Other references showing other types of exercising apparatus are illustrated in U.S. Pat. Nos. 3,162,442 dated Dec. 22, 1964; and 4,478,414 dated Oct. 23, 1984 which show resilient flexible cables or elastic members utilized for exercising leg muscles of a user.

SUMMARY OF THE INVENTION

The exercising apparatus comprising the present invention is particularly directed to an apparatus in which two independent tensioning devices are utilized, one in front of a user and the other in back of a user. By such positioning and connection of two separate tensioning devices to a single body portion, a continuous and constant tension may be applied to the user through flexible cables of the tensioning devices upon a back and forth reciprocal movement of the body portion of the user, such as a leg effective for exercising muscles adjacent the knee joint. The tensioning devices are mounted for movement relative to the user and may be located on either side of the user as desired. The location of the tensioning devices would normally be changed when connected to different legs of the user. The rear tensioning device is mounted for adjustable movement in a generally horizontal direction between right and left sides of the user and the front tensioning device is mounted for pivotal movement between right and left sides of the user. Thus, a desired angular relationship may be provided between a body portion of a user and the tensioning devices such as for exercising a desired leg muscle, for example.

Tension forces are normally applied through flexible cables extending from the front and rear tensioning devices connected to opposite sides of a cuff or band extending around the ankle of the user. The cables are wound around a drum on the respective tensioning device and a predetermined resistance against unwinding of the cable upon movement of the leg away from the tensioning device is provided. Thus, a predetermined magnitude of force is exerted against movement of the leg in a prescribed pattern, such as may be prescribed or recommended by a trainer or physical therapist for an athlete, for example. By having the tensioning devices mounted for movement to various locations, a highly versatile exercising apparatus has been provided in which various types of exercises for various portions of the body of a user may be employed.

It is an object of this invention to provide an exercising apparatus in which a generally continuous and constant tension is applied to the user upon a back and forth reciprocal movement of a portion of the body of a user which is attached to the apparatus.

It is a further object of this invention to provide such an apparatus in which two independent tensioning devices are utilized, one in front of a user and the other in back of a user, each connected by a flexible cable or the like to the user for providing a generally constant force in opposed directions of movement of the body of a user.

Another object of the invention is to provide a tensioning device for such apparatus in which a flexible cable wound on a slidable drum may have a predetermined resistance against an extension or unwinding of the cable.

It is an additional object of the invention to provide exercising apparatus particularly adapted for exercising muscles adjacent the knee joint of a leg by utilizing a cuff about the ankle of the user with the cuff being connected on opposed sides thereof to two independent tensioning devices for applying a tensioning force thereto.

Other objects, features, and advantages of this invention will become more apparent after referring to the following specification and drawings.

DESCRIPTION OF THE INVENTION

FIG. 1 is a top plan of the exercising apparatus comprising the present invention and including a seat for a user of the apparatus and front and rear tensioning devices arranged for attachment to the body of the user;

FIG. 2 is a side elevational view of the exercising apparatus shown in FIG. 1;

FIG. 3 is a front elevational view of the exercising apparatus shown in FIG. 1 with the front and rear tensioning devices being on the left side of a user;

FIG. 4 is a perspective view, partially schematic, showing a user positioned on the seat and having an ankle cuff about the right leg with flexible cables extending therefrom to front and rear tensioning devices for exercising the right knee;

FIG. 5 is a perspective view similar to FIG. 4 but showing the front and rear tensioning devices connected to the left leg for exercising the muscles adjacent the right knee of the seated user;

FIG. 6 is a front elevation of the rear tensioning device mounted on a guide rail for selective positioning thereon;

FIG. 7 is a section taken generally along line 7—7 of FIG. 6;

FIG. 8 is a front elevation of the front tensioning device mounted on the upper end of a pivotally mounted support leg;

FIG. 9 is a front elevation of the front tensioning device mounted on the side of the support leg with the leg being secured at an angular relation;

FIG. 10 is an enlarged top plan of the rear tensioning device removed from the exercising apparatus;

FIG. 11 is a section taken generally along line 11—11 of FIG. 10 and showing means to adjust the tensioning exerted by the cable; and FIG. 12 is a section taken generally along line 12—12 of FIG. 10 showing means mounting the drum for the cable and means to retract the cable.

Referring now to the drawings for a better understanding of the invention, the exercising apparatus comprising the present invention is generally indicated at 10 and includes a base frame 12 which comprises a rear generally horizontally extending beam or guide rail 14, a front support base 16, and a connecting beam 18 extending between and secured to rear beam 14 and front base 16. A chair indicated generally at 20 is mounted on beam 18 and has a seat 21 for seating a user U of exercising apparatus 10. User U shown schematically in FIGS. 4 and 5 has legs L and ankles A. A suitable cuff 22 may be placed about ankle A for connecting leg L to exercising apparatus 10 for exercising a knee, for example. Cuff 22 is preferably formed of a soft cushioning material to protect the ankle A of the user during the exercising and includes a pair of opposed hooks 23 thereon with the forces being applied to cuff 22 and ankle A through hooks 23.

A rear tensioning device is generally indicated at 24 and has a flexible cable 26 extending therefrom for being connected to associated hook 23 on cuff 22 about ankle A of user U. Rear tensioning device 24 is mounted for generally horizontal adjustable movement along guide side or beam 14. A front tensioning device is shown generally at 28 and has a flexible cable or rope 30 extending therefrom connected to an opposed hook 23 on cuff 22. Tensioning device 28 is mounted for vertical adjustment along a generally vertically extending leg 32 which is mounted for pivotal movement about pivot 34 on front base 16.

Chair 20 is supported by vertical legs 36 secured to a lower plate 37 which is secured to connecting beam 18, and a generally horizontal upper plate or base 38 extends between the upper ends of legs 36. A sleeve 40 secured to plate 38 receives a vertically extending rod 42 extending from seat 21 and mounting seat 21 for vertical adjustment relative to sleeve 40 upon adjustment of adjusting screw 44. Seat 21 is also mounted for rotative movement relative to sleeve 40 by adjustment of adjusting screw 46. Suitable slots 53 as shown particularly in FIG. 1 are provided in seat 21 and are adapted to receive leg straps 55 which have Velcro ends for securing straps 55 about the legs of a user to stabilize the leg during exercising. A back rest 50 is mounted on a flexible strap 52 for adjustable in and out movement relative to the underside of seat 21 by adjustment of adjusting screw 56. Thus, seat 21 is mounted for vertical and rotative adjustments relative to support plate 38 while back rest 50 is mounted for back and forth adjustment in a horizontal direction relative to seat 21. Elongate hand grips 57 extend from the underside of seat 21 and may be gripped by a user to maintain a position on seat 21.

Rear tensioning device 24 and front tensioning device 28 are identical and for the purposes of illustration, only tensioning device 24 will be described in detail, it being understood that tensioning device 28 is identical thereto with the same reference numerals being utilized for similar elements. Tensioning device 24 as shown in FIGS. 6, 7 and 10–12 includes a shoe or slidable plate 58 supported on rail 14 and having a clamp plate 60 having overlapping guide rail 14. A suitable adjusting screw 62 is threaded within an internally threaded opening on clamp plate 60 and may be tightened against guide rail 14 for securement of tensioning device 24 thereon.

A vertical rod 64 extends upwardly from adjustable, slidable plate 58 and is received within a clamping member 65 on a support base 66. An adjusting screw 68 for clamping member 65 allows tensioning device 24 to be vertically adjusted along rod 64 at a desired height. A pair of end bearing supports or housings 70 on base 66 support a main shaft 72 for rotation. A pair of spaced hubs 74 are fixed to shaft 72 and have a pair of guide rods 76 secured therebetween. A drum 77 is mounted on shaft 72 and guide rods 76 for sliding movement therealong between hubs 74 upon winding and unwinding of cable 26 from drum 77. The eccentrically mounted guide rods 76 rotate with hubs 74 and effect rotation of drum 77. Flexible cable 26 is wound onto a continuous spiral groove 78 on the outer circumference of drum 77. CAble 26 is guided by a bevelled opening 79 in a vertical plate 80 secured to base 66 adjacent drum 77. Drum 77 slides along shaft 72 as cable 26 is being wound and unwound on drum 77. A spiral coil sprng 82 is mounted within bearing housing 70 and has its inner end fixed to shaft 72 to continuously urge drum 77 to a retracted position with respect to cable 26 for winding cable 26 onto drum 77. A guide 84 mounted on a vertical support 85 secured to base 66 extends within groove 78 and engages cable 26 to maintain cable 26 within groove 78 as it is being wound and unwound from drum 77.

To vary the resistance to the extension or unwinding of flexible cable 26 from drum 77, a sprocket chain 86 is mounted between a clutch member 88 on shaft 72 and a sprocket 90 on shaft 92 mounted for rotation within bearing supports 94. A pair of split housings 96 as shown in Figure 11 are pivotally connected to each other by links 98 and have split sleeve halves 100 mounted in contact with the outer circumference of shaft 92. The ends of housings 96 opposite links 98 are spaced apart. A manually rotatable knob 102 is received within upper housing 96 and has a threaded end extending within an internally threaded opening in lower housing 96. Upon rotation of knob 102 in one direction, sleeves 100 are tightened about shaft 92 to increase the friction exerted thereupon thereby to increase the resistance to the extension of cable 26. The amount of resistance can be adjusted from around two (2) pounds to an amount preventing rotation of shaft 92 and shaft 72 in the direction for unwinding cable 26. Clutch member 88 releases shaft 72 for free relative rotation in an opposite direction upon the retraction or winding of cable 26 onto drum 77 thereby to permit drum 77 to be easily rewound under the bias of coil spring 82.

Referring now to front tensioning device 28 in which like reference numbers refer to similar elements, shoe 58 and plate 60 thereof may be suitably supported on an upper support member 104 on the upper end of leg 32 and clamped thereto by clamp 62. Also, tensioning device 28 may be mounted or positioned on opposed sides 106 of leg 32 for providing a desired angular relationship with the ankle or other body portion of user U of exercising apparatus 10. Leg 32 is of an I-beam construction and the flanges thereof form sides 106 to which tensioning device 28 may be suitably positioned and secured at the desired height. For pivoting of leg 32 about pivot 34, an arcuate support 108 has a clamping plate 110 riding along its arcuate surface as shown in FIG. 9 and an adjusting screw 112 may be tightened for clamping plate 110 against support 108 at the desired angular position of leg 32.

While exercising apparatus 10 may be utilized for various types of exercising, exercising apparatus 10 is particularly adapted for exercising muscles associated with the knee joint upon movement of the knee in a rotational motion. Tensioning devices 24 and 28 may be selectively positioned along respective guide rail 14 and leg 32 for exerting a force through cuff 22 against the ankle from a preselected angle and a preselected height. For example, FIG. 4 illustrates the positioning of tensioning devices 24 and 28 for exercising the right knee of a user and Figure 5 illustrates the positioning of tensioning devices 24 and 28 for exercising the left knee of a user. Such positioning of tensioning devices 24 and 28, may, for example, be provided in accordance with an exercising program designed by a trainer for the user, such as a football player.

For exercising the left knee as shown in FIG. 5, for example, the user U is seated on seat 21 with the knee bent at a ninety (90) degree angle and the foot slightly raised off the floor. Cuff 22 is positioned around the ankle of user U and has hooks 23 on opposite sides thereof. Tensioning devices 24 and 28 are positioned at the location shown in FIG. 5 and cables 26 and 30 are then connected to hooks 23 on cuff 22 for exerting a force thereon. The user then rotates the lower leg in a prescribed motion and during this exercise flexible cables 26 and 30 are being extended and retracted continuously for exerting a generally constant force against the ankle during the entire prescribed motion of the leg. The amount or magnitude of the resistance may be preselected for each of the tensioning devices 24 and 28 by adjustment of control knobs 102 and thus the selected resistance in each direction may be predetermined as the user rotates the knee during extension and retraction. The leg may be moved in a so-called soccer style direction, for example, and external rotation of the leg in an extension of the leg in a forward movement. After a number of repetitions of a particular exercise have been satisfied, seat 21 may be rotated to provide a force exerted by flexible cables 26 and 30 from a different direction. A high resistance from cables 26 an 30 is desirable for stability strengthening of the knee, and a light resistance is desirable for permitting a relatively high rate of speed in the rotary exercise.

It is apparent that exercising apparatus 10 comprising the present invention may be utilized with various types of exercises but is particularly adapted for rehabilitation of body portions where rotation may be involved in the particular exercise, such as rehabilitating an ankle, shoulder, or knee. In some exercises a single tensioning device 24 may be utilized, for example, by gripping the extending end of flexible cable 26 extending from the tensioning device.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Exercising apparatus comprising:

seat means on which a user is seated for exercising a body portion; said seat means further including;

a separate tensioning device mounted on each of the front and back sides of the seat means; and a flexible cable extending from each tensioning device to said seat means and adapted to be releasably connected to said body portion of the user on the seat means for exerting a predetermined force thereon upon pulling of said cable away from its associated tensioning device, one of said cables exerting said predetermined force when said body portion moves away from its associated tensioning device on the front side of the seat means and the other cable exerting said predetermined force when said body portion moves away from its associated tensioning device on the back side of the seat means.

2. Exercising apparatus as set forth in claim 1 wherein each of the tensioning devices may be manually set to exert a predetermined resistance against pulling of the associated cable away from its tensioning device.

3. Exercising apparatus as set forth in claim 1 wherein means mount said seat for rotational and vertical adjustments.

4. Exercising apparatus as set forth in claim 3 wherein a back rest is provided for said seat, and means mount said back rest for horizontal adjustment relative to said seat.

5. Exercising apparatus as set forth in claim 1 wherein means mount the tensioning device on the back side of the seat for adjustable movement in a generally horizontal direction between right and left sides of the user.

6. Exercising apparatus as set forth in claim 1 wherein means mount the tensioning device on the front side of the seat for pivotal movement between right and left sides of the user.

7. Exercising apparatus comprising:

a base frame;

a seat on the base frame on which a user is seated for exercising a body portion;

as first tensioning device mounted on the base frame adjacent the back of the seat;

means mounting the first tensioning device on the base frame for movement between opposite sides of the seat and the user seated thereon;

a first flexible cable extending from said first tensioning device and having its extending end adapted to be connected to the body portion of the user on the seat for exerting a force thereon upon extension of said cable away from its associated tensioning device;

a second tensioning device mounted on the base frame adjacent the front of the seat;

means mounting said second tensioning device on the base frame for movement between opposite sides of the seat and the user seated thereon; and a second flexible cable extending from said second tensioning device and having its extending end adapted to be connected to said body portion of the user for exerting a force thereon upon extension of said second cable away from its associated tensioning device towards the seat, said first and second flexible cables thereby exerting forces in generally opposite directions for exercising said body portion of the user in generally opposed directions of movement.

8. Exercising apparatus as set forth in claim 7 wherein said means mounting said second tensioning device for movement between opposites sides of the seat comprises a generally vertical extending leg pivotally mounted at its lower end for movement in a generally vertical plane and having a retractable drum mounted thereon for winding the associated cable thereabout.

9. Exercising apparatus as set forth in claim 8 wherein said second tensioning device is mounted for adjustable movement along said vertical extending leg.

10. Exercising apparatus as set forth in claim 7 wherein said means mounting said first tensioning device for movement includes a generally horizontal extending fixed guide on which said first tensioning device is slidably mounted for selected positioning therealong.

11. Exercising apparatus for exercising a leg of a human body and particularly the leg muscles adjacent the knee joint of the leg; said exercising apparatus comprising:

support means for supporting the apparatus;

a seat on the support means on which a user is seated with the leg extending therefrom;

a first tensioning device mounted on the support means adjacent the back of the seat;

a cuff removably mounted about the leg of the user to be exercised;

a first flexible cable extending from said first tensioning device and having its extending end connected to said cuff for exerting a force thereon upon extension of said cable away from its tensioning device;

said cuff for exerting a force thereon upon extension of said cable away from its tensioning device;

means mounting said first tensioning device on the support means for selected movement between opposite sides of the seat;

a second tensioning device mounted on the support means adjacent the front of the seat;

a second flexible cable extending from said second tensioning device and having its extending end connected to said cuff for exerting a force thereon upon extension of said second cable away from said second tensioning device; and means mounting said second tensioning device on the support means for selective movement between opposite sides of the seat, said first and second tensioning devices and associated cables exerting forces in generally opposite directions thereby to exert a continuous force against said leg upon reciprocal back and forth movement of the leg for exercising the leg muscles.

12. Exercising apparatus as set forth in claim 11 wherein means mount said seat for rotation and for selective adjustment of the height of said seat.

13. Exercising apparatus as set forth in claim 11 wherein said means mounting said second tensioning device for movement between opposite sides of the seat comprises a generally vertical extending support pivotally connected at its lower end for pivotal movement in a generally vertical plane.

14. Exercising apparatus as set forth in claim 11 wherein said means mounting the first tensioning device for movement include a generally horizontal extending fixed rail on which said first tensioning device is slidably mounted for selective position therealong.

15. Exercising apparatus for exercising selective muscles of a user comprising:

base support means;

a first tensioning device mounted on the base support means for being positioned adjacent the front of the user;

a second tensioning device mounted on the base support means for being positioned adjacent the back of the user;

a band-like member mounted about a selected portion of the body of the user through which forces are transmitted to the body for exercising muscles associated with said selected body portion;

a first flexible cable extending from said first tensioning device to one side of said band-like member;

a second flexible cable extending from said second tensioning device to an opposite side of said band-like member; and means mounting one of said tensioning devices on the base support means for selective movement between opposite sides of the body, said first and second tensioning devices and associated cables exerting forces in generally opposite directions against said band-like member thereby to exert a generally continuous force against said selected body portion upon back and forth movement thereof.

16. Exercising apparatus as set forth in claim 15 wherein each of said tensioning devices includes a rotatable drum on which associated cable is wound; and means is provided to selectively vary the tensioning forces exerted by the drum against its associated cable.

17. In a tensioning device for exercising apparatus;

a generally cylindrical drum mounted for rotation and having a continuous spiral groove in its outer circumferential surface;

resistance means for providing resistance to rotation of the drum;

a flexible cable having at its end a gripping means for releasable engagement by a user for exercising a force thereon wound about said drum and received within said spiral groove;

a shaft on which said drum is mounted;

means mounting said drum for rotation with said shaft and for axial sliding movement along said shaft as the cable is being wound and unwound on said drum, said means including a pair of axially spaced hubs secured to said shaft on opposed ends of said drum and a pair of guide rods in parallel relation to said shaft extending between and secured to said hubs, said guide rods extending through said drum thereby to effect rotation of said drum upon rotation of said shaft; and fixed guide means for said cable adjacent said drum to permit the extension and retraction of said cable on said drum from a single fixed location.

18. In a tensioning device as set forth in claim 17 wherein adjustable resistance means are provided to vary the resistance against rotation of said shaft and the force required for extension and unwinding of the cable from the drum.

19. In a tensioning device as set forth in claim 17 wherein clutch means are associated with said adjustable resistance means for releasing said adjustable resistance means upon rotation of said shaft in one direction.

* * * * *